United States Patent [19]

Dillemuth

[11] 4,218,083

[45] Aug. 19, 1980

[54] DOOR HOLDING LATCH

[76] Inventor: Arnold H. Dillemuth, 4680 Norma Dr., San Diego, Calif. 92115

[21] Appl. No.: 26,960

[22] Filed: Apr. 4, 1979

[51] Int. Cl.[2] ..... E05C 17/30

[52] U.S. Cl. ..... 292/262

[58] Field of Search ..... 292/262, 275, 278, 305, 292/306, 338; 403/85, 109

[56] References Cited

U.S. PATENT DOCUMENTS

| | | | |
|---|---|---|---|
| 1,357,714 | 11/1920 | Lane | 287/58 X |
| 2,291,412 | 7/1942 | Schonitzer | 292/275 X |
| 2,483,396 | 10/1949 | Benson | 403/109 |
| 2,724,609 | 11/1955 | Donnelly | 292/266 |

*Primary Examiner*—Richard E. Moore

*Attorney, Agent, or Firm*—Brown & Martin

[57] ABSTRACT

A door holding latch, primarily for holding a door in open position, using a telescopic strut with an enclosed cam latch which engages when the strut is collapsed. The cam latch is incorporated in an end of a torsionally resilient rod which slides in a sleeve and engages a latch pin extending across the sleeve, the cam being angularly offset so that the rod must twist as the cam engages the pin. The torsion applied to the rod locks the cam in place, the latch being released by a pull on the door sufficient to overcome the frictional grip of the latch.

6 Claims, 6 Drawing Figures

DOOR HOLDING LATCH

BACKGROUND OF THE INVENTION

In vehicles such as campers, vans, motor homes and the like, and in some types of buildings, it is sometimes necessary to hold a door in an open position for ease of access, ventilation, or other such reasons. One of the most common types of retaining device is a simple hook and eye, which usually holds a door back against the surrounding structure. This and similar devices require the user to reach around or behind the door to engage or release the latch. Other mechanisms include spring or fluid operated door closers, which can be locked in open position. These are usually mounted on top of the door and require reaching up over the door to release the lock.

It would be advantageous to have a simple mechanism which is latched and unlatched merely by pushing or pulling on the door itself.

SUMMARY OF THE INVENTION

The door latch described herein is a simple telescopic strut which is secured between a door and its supporting or surrounding structure. In closed position the strut is substantially flat against the door and in open position extends diagonally between the door and structure.

The strut comprises a rod sliding in a sleeve, the opposite ends of the rod and sleeve being pivotally attached to brackets which are secured to the door and adjacent structure. The rod is torsionally resilient and has a notched cam which passes over and locks on a latch pin extending across the sleeve, when the door is moved to the open position. Secure latching is obtained by angularly offsetting the cam from the axis of the hinge pin of the rod, so that the rod is twisted by the action of the cam riding over the latch pin. The torsional load on the rod holds the cam tightly on the pin and will hold the door securely even under strong wind loads. However, by using the considerable leverage of the door, the torsional grip of the cam can be overcome and the latch released by pulling the door toward the closed position. The latch is concealed in the strut and does not require access for its operation.

The primary object of this invention, therefore, is to provide a new and improved door holding latch.

Another object of this invention is to provide a door holding latch with a torsionally load cam latch concealed in a telescopic strut secured between the door and adjacent structure.

Another object of this invention is to provide a door holding latch which is latched and released by intentional movement of the door.

A further object of this invention is to provide a door holding latch which is adaptable to a wide variety of door installations.

Other objects and advantages will be apparent in the following detailed description, taken in conjunction with the accompanying drawing, in which.

DESCRIPTION OF THE PREFERRED EMBODIMENT

Figure 1:
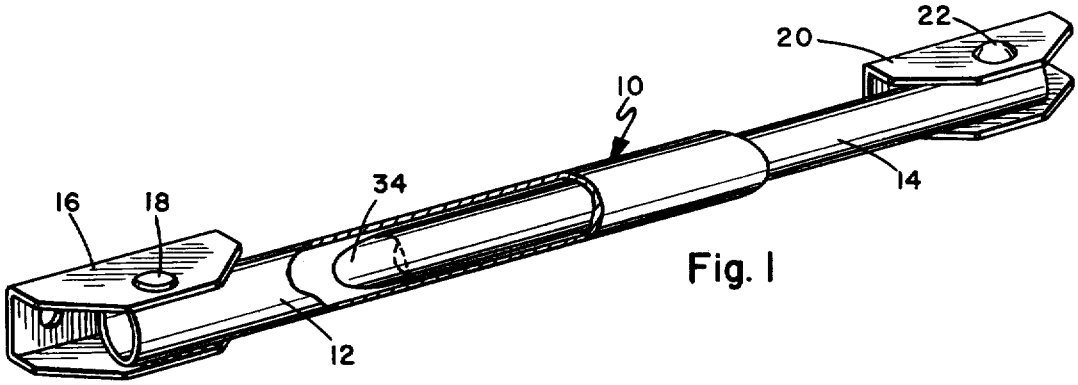
FIG. 1 is a perspective view of the door latch unit.

The latch comprises a telescopic strut 10 having a tubular sleeve 12, in which a latch rod 14 is axially slidable. One end of the sleeve 12 is pivotally attached to a saddle type bracket 16 by a pin 18, and the opposite end of latch rod 14 is pivotally attached to a similar bracket 20 by a hinge pin 22. Pin 22 is preferably not permanently secured but is a push fit through bracket 20 and latch rod 14, so that the strut can be disconnected when necessary.

Figure 2:
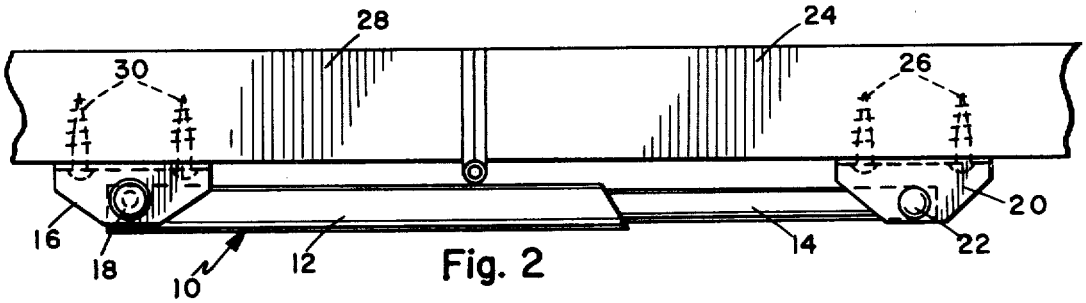
FIG. 2 is a top plan view of the latch unit attached to a door in the closed position of the door.
Figure 3:
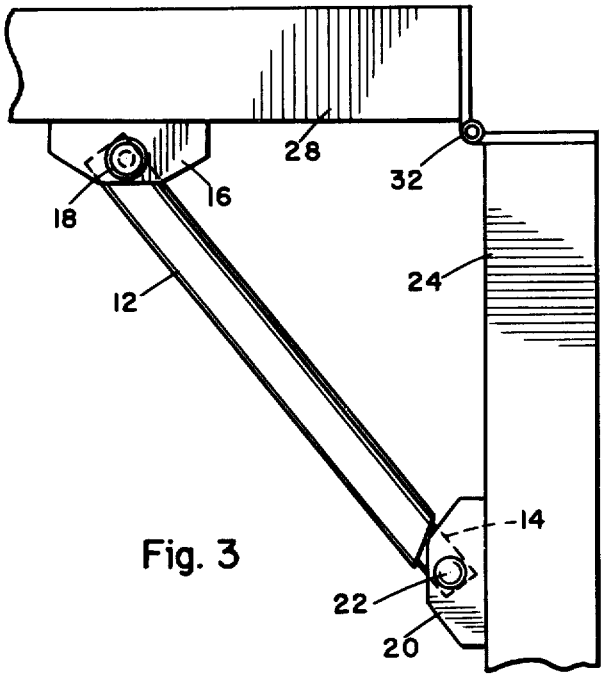
FIG. 3 is a similar view with the door in the latched open position.

The strut is attached to a door 24 by securing bracket 20 to the door with screws 26, or the like. Bracket 16 is similarly secured to the fixed structure or wall 28 at the side of the door by screws 30. In the mounted position the strut is substantially horizontal and the pins 18 and 22 are vertical and parallel. In the closed position of the door, shown in FIG. 2, the strut is generally flat against the surface of the door and adjacent structure. When the door is opened on its hinges 32, as in FIG. 3, the strut 10 collapses and extends diagonally between the door 24 and wall 28. The door is shown perpendicular to the wall, but it will be obvious that the length of the strut and the attachment points may be arranged to hold the door open at any required angle.

Figure 4:
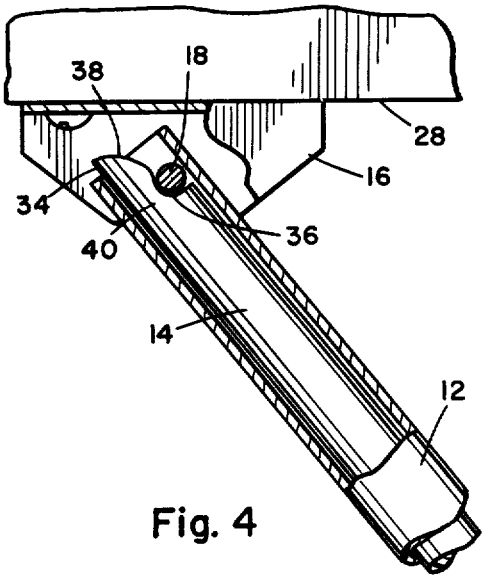
FIG. 4 is an enlarged view similar to a portion of FIG. 3, with portions cut away to show the cam latching action.
Figure 6:
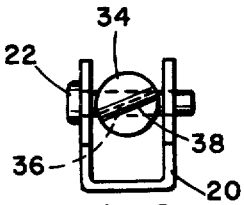
FIG. 6 is an end elevation view as taken from the left hand end of FIG. 5.
Figure 5:
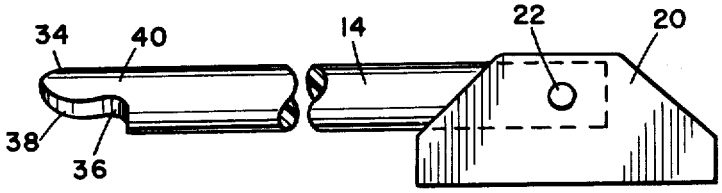
FIG. 5 is an underside view of the cam latch plunger and bracket.

To latch the door open, the end of latch rod enclosed in the sleeve has a wedge-like head 34, at the base of which is an undercut notch 36 extending substantially diametrically across the rod. Head 24 is dimensioned to pass closely between pin 18 and the wall of sleeve 12, so that the pin is seated in notch 36, as in FIG. 4. Pin 18 thus serves as a hinge and a latch pin. To provide a firm latching action the cam face 38 and the undercut face of notch 36 are similarly angularly offset from the axis of hinge pin 22, as indicated in FIGS. 5 and 6. Since pin 18 is parallel to hinge pin 22, the cam face 38 engages the pin 18 at an angle and must be forced past the pin by pushing against the door. This causes a torsion to be applied to the latch rod 14, which binds the head 34 firmly behind pin 18. To obtain the required torsional properties, the latch rod is preferably made from a tough resilient plastic material such as Delrin, or the like.

For maximum strength the neck portion 40 of the head, at the notch 26, is made as thick as possible, preferably about half the diameter of the latch rod. For this purpose the pin 18 is offset from the diametrical position across sleeve 12, so that there is a large passage between the pin and the wall of the sleeve for the head to pass. By making the neck 40 thick, the torsion is applied along the length of latch rod 14, instead of just at the head, which provides a more secure locking action and distributes the torsional stress more evenly.

It has been found that the torsion locked latch will hold a door against a strong wind, but can be readily disengaged when necessary. Due to the leverage advantage of the door, a firm pull at the outer edge of the door will pull the head 34 back over pin 18, allowing the door to be closed. The latch can thus be engaged and disengaged by simply opening and closing the door, without the necessity for reaching around or behind the door.

The precise shape of the head 34 may vary to some extent. For instance, the taper could be curved as shown, or a flatter wedge, and the edges could be rounded slightly to assist the twisting action as the head is forced past the pin. Latch rod 14 is shown as being of circular cross section as made from bar stock, but could be of some other cross section to facilitate manufacture by injection molding, where a large solid cross section is undesirable.

The latch is very simple in construction with the latch elements enclosed and protected. When installed the unit is compact and unobtrusive, and does not interfere with normal opening and closing of the door short of the latched position.

Having described my invention, I now claim:

1. A door holding latch, comprising:

a telescopic strut having an elongated tubular sleeve with a torsionally resilient cylindrical latch rod axially slidable therein;

opposite ends of said sleeve and latch rod having means for attachment between a door and adjacent supporting structure;

said sleeve having a latch pin extending therethrough;

the end of said latch rod enclosed in the sleeve having a tapered head to pass between the latch pin and the wall of the sleeve, with a notch extending across the rod to receive the latch pin, said notch being angularly offset from the axis of the latch pin, whereby the latch rod is torsionally twisted when the notch is engaged with the latch pin.

2. A door holding latch according to claim 1, wherein said means for attachment comprises a first bracket pivotally attached to said sleeve by said latch pin, and a second bracket with a hinge pin pivotally holding said latch rod therein;

and means for securing said brackets to a door and adjacent supporting structure, with the strut extending substantially perpendicularly across the hinge line of the door and the axes of said latch pin and hinge pin parallel to each other.

3. A door holding latch according to claim 2, wherein said notch is undercut at the base of said head and extends substantially diametrically across the latch rod, angularly offset from the axis of said hinge pin.

4. A door holding latch according to claim 3, wherein said latch pin extends chordally across the sleeve, with a larger space between the latch pin and the wall of the sleeve on one side than on the other, said head being a close fit through the larger space.

5. A door holding latch according to claim 4, wherein said latch rod has a neck portion at said notch with a thickness substantially half the diameter of the latch rod.

6. A door holding latch according to claim 4, wherein said tapered head is generally wedge shaped, with a latch pin engaging cam face parallel to said notch.

* * * * *